US006678386B2

(12) United States Patent
Robinson et al.

(10) Patent No.: US 6,678,386 B2
(45) Date of Patent: Jan. 13, 2004

(54) PROGRAMMABLE MODULE

(75) Inventors: Scott J. Robinson, Forest Lake, MN (US); Kurt Bartges, Anoka, MN (US)

(73) Assignee: Resistance Technology, Inc., Arden Hills, MN (US)

( * ) Notice: Subject to any disclaimer, the term of this patent is extended or adjusted under 35 U.S.C. 154(b) by 312 days.

(21) Appl. No.: 09/805,585

(22) Filed: Mar. 13, 2001

(65) Prior Publication Data

US 2001/0036288 A1 Nov. 1, 2001

Related U.S. Application Data

(60) Provisional application No. 60/188,789, filed on Mar. 13, 2000.

(51) Int. Cl.[7] ..... H04R 25/00
(52) U.S. Cl. ..... 381/323; 381/314
(58) Field of Search ..... 381/323, 312, 381/322, 314, 315, 324, FOR 127, FOR 129, FOR 137

(56) References Cited

U.S. PATENT DOCUMENTS 4,961,230 A * 10/1990 Rising ..... 381/323
5,799,095 A 8/1998 Hanright ..... 381/68
5,915,031 A * 6/1999 Hanright ..... 381/323
6,088,465 A * 7/2000 Hanright et al. ..... 381/323

FOREIGN PATENT DOCUMENTS

DE 44 44 586 C1 3/1996

* cited by examiner

*Primary Examiner*—Curtis Kuntz
*Assistant Examiner*—Brian Ensey
(74) *Attorney, Agent, or Firm*—Kinney & Lange, P.A.

(57) ABSTRACT

The present invention generally relates to a self-contained, discrete programmable module for a programmable hearing aid, in which the self-contained discrete programmable module includes a plastic housing having a first wall and a second wall, in which the first and second walls define a slot, and the first and second walls having at least one shoulder that is effective in slanting the slot. The present invention further includes a plurality of electrical leads disposed within the plastic housing, such that the electrical leads are integrally formed within the second wall and a third wall of the plastic housing, in which each electrical lead extends into the slot, and each electrical lead is effective in providing a force that retains a programmable cable inserted therein for programming the programmable module.

13 Claims, 6 Drawing Sheets

PROGRAMMABLE MODULE

CROSS-REFERENCE TO RELATED APPLICATION(S)

The present application claims priority from application Ser. No. 60/188,789, which was filed on Mar. 13, 2000.

BACKGROUND OF THE INVENTION

The present invention relates to programmable hearing aids. More specifically, the present invention relates to a programmable module for use in a programmable hearing aid.

Over the past decade, hearing aids have evolved to include complete insertion into a patient's ear canal so that a face of the hearing aid is flush with or below an entrance to the patient's ear canal. Such hearing aids are referred to as "Completely-In-the-Canal" or "CIC" hearing aids in the industry. Additionally, the face of the CIC hearing aid may include a variety of operational components, such as a microphone, a tuner, an amplifier, a retrieval line, a receiver, or the like, to enhance performance of the hearing aid for a patient.

Accordingly, such operational components have become progressively more sophisticated, and modification of a hearing aid to include, for example, adjustment of a level of background noise detected, speech intelligibility, attenuation of sounds or even programming a level of sound coming from an environment is now common in the CIC hearing aid. Such hearing aids, termed "programmable hearing aids", permit adjustment of operational components to maximize performance of the CIC hearing aid.

Typically, such programmable hearing aids are programmed while they are in the patient's ear canal. Currently, programming of a hearing aid is accomplished via insertion of a programmable cable into a programmable module located on the face of the hearing aid.

Nevertheless, programming remains challenging for a number of reasons. For example, proper location and orientation of the programmable module on the face of the hearing aid is difficult since hearing aids also position operational components that limit space available on the face for the programming module. Similarly, if the programmable module is not properly oriented with respect to the face, cable insertion becomes challenging, and may even result in damage to the cable, or even the entire hearing aid during programming.

Additionally, programmable hearing aids are custom-fitted to the patient's ear. With many variations in size and shape being possible for a programmable hearing aid, the inclusion of a programmable module may require extensive experimentation, and therefore, the use of highly skilled workers to manufacture the hearing aid. Such use of skilled workers typically increases the costs of programmable hearing aids.

Current programmable hearing aids position the programmable module in integral communication with a battery module which permits a battery door of the battery module to facilitate an operable connection between the programmable cable and the programmable module via opening and shutting of the battery door. Nevertheless, such positioning typically limits the option of placing the programmable module at any surface of the face to support proper positioning of other operational components during custom-fitting of the hearing aid for the patient.

BRIEF SUMMARY OF THE INVENTION

The present invention generally relates to a self-contained, discrete programmable module for a programmable hearing aid, in which the self-contained discrete programmable module includes a plastic housing having a first wall and a second wall, in which the first and second walls define a slot, and the first and second walls having at least one shoulder that is effective in slanting the slot. The present invention further includes a plurality of electrical leads disposed within the plastic housing, such that the electrical leads are integrally formed within the second wall and a third wall of the plastic housing, in which each electrical lead extends into the slot, and each electrical lead is effective in providing a force that retains a programmable cable inserted therein for programming the programmable module.

DETAILED DESCRIPTION

The present invention relates to programmable hearing aids. More specifically, the present invention relates to a programmable module for use in a programmable hearing aid.

Figure 1:
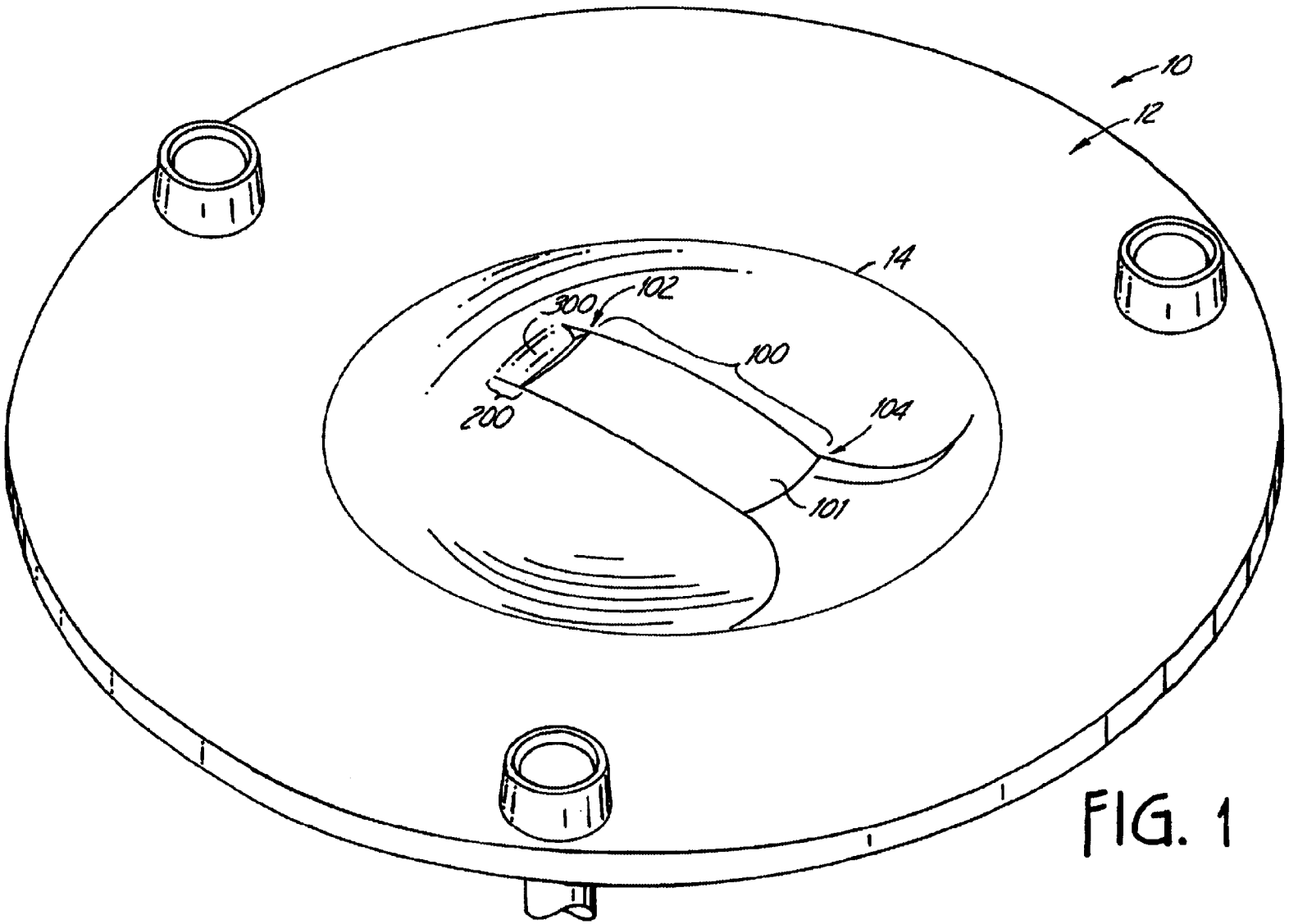
FIG. 1 is a perspective view of a top portion of a hearing aid faceplate showing the faceplate, a battery portion and a programmable module portion.

A top portion of a faceplate that can be used to assemble a programmable hearing aid in accordance with the present invention is generally depicted at 10 in FIG. 1. The faceplate 10 is formed of a circular plate 12. The faceplate 10 includes a battery portion 100 and a programmable module portion 200. The battery portion 100 has an anterior end 102 and a posterior end 104. The anterior end 102 of the battery portion 100 is preferably positioned adjacent to the programmable module portion 200.

The battery portion 100 of the faceplate 10 further includes a battery door 101 that is depicted in a closed position in FIG. 1. The battery door 101 is snap fit onto a door pin (not shown) via cooperation of a door pin opening (not shown) of a door bracket (not shown) located on the battery door 101 to close the battery door 101. Alternatively, the battery door 101 may be forced or friction fit into the closed position by providing an outer lip (not shown) of the battery door 101 with a slightly smaller diameter than the battery door 101.

The faceplate 10 is used to construct a face 14 for the programmable hearing aid as is well known in the art. The face 14 encloses a shell (not shown) that houses operational components, such as a battery 108, a microphone assembly (not shown), a receiver (not shown) and a trimmer (not shown) of the programmable hearing aid. The faceplate 10 is typically dimensioned larger than the face 14 required for the programmable hearing aid.

The faceplate 10 is typically formed of a polymeric material, such as Tenite® propionate sold by Eastman Kodak Company Corporation of Rochester, N.Y.

As best depicted in FIG. 1, the faceplate 10 includes a self-contained discrete programmable module 300, inserted into the programmable module portion 200. Although the programmable module portion 200 is depicted at the anterior end 102 of the battery portion 100, the programmable module portion 200 is separate, distinct, and independent of the battery portion. Furthermore, the programmable module portion 200, along with the module 300 may be located at any position on the faceplate 10 in accordance with the present invention.

Such flexibility in positioning the programmable module portion 200 at any location on the faceplate 10 provides many advantages to a manufacturer of programmable hearing aids. For example, programmable hearing aids are typically custom-fitted to the client's ear. Space on the faceplate 10 is therefore limited with further restrictions encountered when other faceplate components are combined. A programmable module portion 200 that can be positioned at any location on the faceplate 10 provides the manufacturer with maximum flexibility for strategically positioning all faceplate components in selected arrangements on the faceplate 10.

In addition, the module 300 can be oriented in any direction to facilitate subsequent insertion of a programmable cable 500 into the cable slot 330 for programming of the programmable hearing aid. Proper orientation of the module 300 is critical to avoid any irregularities in the client's ear during programming of the programmable hearing aid.

The separate, distinct and independent programmable module portion 200 of the present invention is also advantageous during assembly of the programmable hearing aid, since the decision on where to locate the programmable module portion 200 cannot be predicted in advance of the manufacturing process. Such flexibility on where the programmable module portion 200 can be located provides the manufacturer freedom to optimally and efficiently modify the programmable hearing aid to suit the client's needs.

Figure 2:
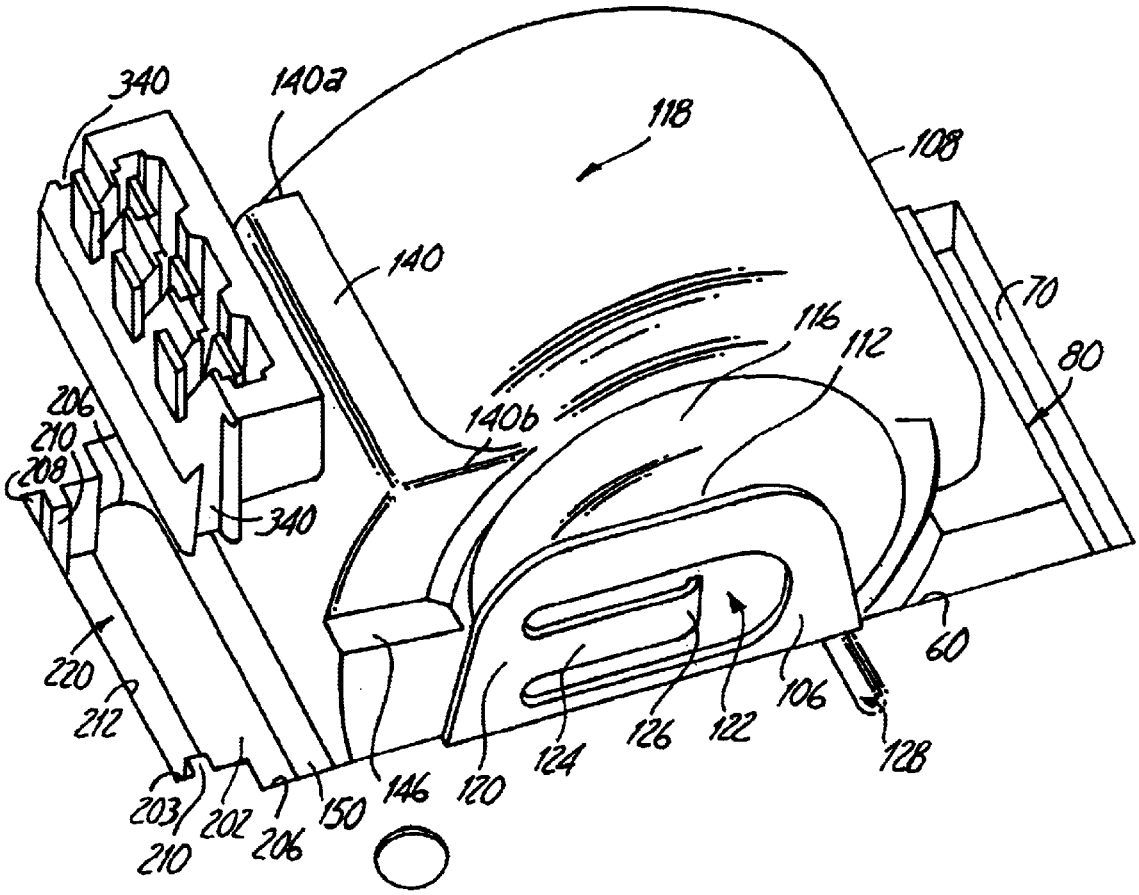
FIG. 2 is a perspective view of a bottom portion of a hearing aid faceplate showing a battery portion housing a battery for powering the hearing aid, and a programmable module portion detached from the faceplate for housing a self-contained discrete programmable module.

A battery compartment 80 is formed within the faceplate 10 and is defined by end walls 70 and 212 and opposed side walls 60, as best depicted in FIG. 2. End wall 70 is at a distal end of the battery compartment 80 and end wall 212 is at a proximal end of battery compartment 80 towards a hinge pin 150. The faceplate 10 further includes opposed battery contacts 106 that extend perpendicularly from the faceplate 10 for contacting a battery 108 inserted into the battery compartment 80 of the battery portion 100. The opposed battery contacts 106 define the battery compartment 80 that houses the battery 108. The opposed battery contacts 106 are supported by the faceplate 10 and are aligned relative to the battery 108 to electrically connect the battery 108 to power any operational components of the programmable hearing aid.

Figure 3:
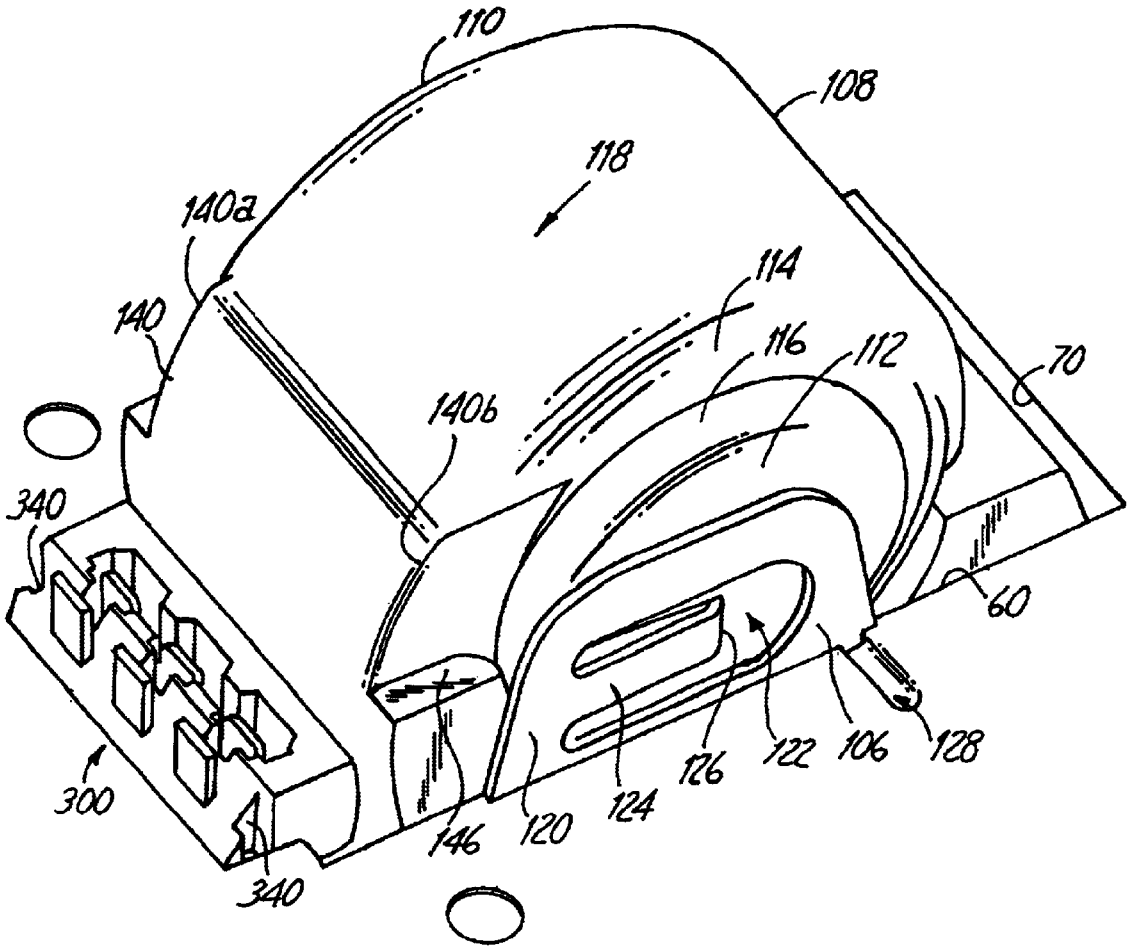
FIG. 3 is a perspective view of a bottom portion of a programmable hearing aid showing a battery portion housing a battery and a programmable module portion attached to the faceplate for housing a self-contained discrete programmable module.

The opposed battery contacts 106 include an oval shaped base 120 having a center opening 122, as best illustrated in FIGS. 2 and 3. The battery contacts 106 include opposed tangs 124, opposed leads 126 and opposed grooves 128 for accepting anchors (not shown) that anchor the battery contacts 106 relative to the faceplate 10. Opposed tangs 124 are elongated flexible cantilevered extensions which extend from a side of the oval shaped base into the center opening 122. Opposed leads 126 extend at an angle from an exposed end of tangs 124 and are normally positioned to extend into the battery compartment 80 to contact ends 110 and 112 of the battery 108 in the battery compartment 80 when the battery door 101 is closed.

A retaining flange 140 of the battery portion 100 extends arcuately below the battery compartment 80 as illustrated in FIGS. 2 and 3. The retaining flange 140 retains the battery 108 when it is inserted in the battery compartment 80. The retaining flange 140 is sized to slightly grip a round extent 118 of the battery 108 when inserted into the battery compartment 80. Opposed sides 140*a* and 140*b* define the width of the retaining flange 140. The retaining flange 140 can also be molded of Tenite® propionate, or the like. Preferably, the retaining flange is molded from the same polymer material as the faceplate 10.

As best depicted in FIG. 3, the battery 108 in the battery portion 100 includes flat end 110 and stepped end 112. The stepped end 112 of the battery 108 defines a ring-shaped recessed portion 114 and a circular raised positive portion 116. The retaining flange 140 includes a shoulder 146 that extends from the anterior end 102 of the battery compartment 80 to the side of the oval shaped base 120 of the battery contacts 106. The shoulder 146 of the retaining flange 140 covers both the ring-shaped recessed portion 114 and the circular raised positive portion 16 of the battery contacts 106, as illustrated in FIG. 3.

As illustrated in FIG. 2, the hinge pin 150 is located at the posterior end 104 of the battery portion 100. The hinge pin 150 is adjacent to the retaining flange 140 that retains the battery 108 when inserted into the battery compartment 80 of the faceplate 10. The hinge pin 150 includes opposed ends 152 (not shown) which extend from opposed side walls 60 of the battery compartment 80 adjacent to and spaced from end wall 212. Opposed ends 152 (not shown) of the hinge pin 150 are integrally formed with opposed side walls 60 of the battery compartment 80. Thus, opposed ends 152 (not shown) are flush with respective opposed side walls 60 of the battery compartment 80.

The programmable module portion 200 of the faceplate 10 includes an elongated member 202, as best depicted in FIG. 2. Elongated member 202 is located adjacent to and away from the hinge pin 150. The elongated member 202 also has opposed ends 204 and 206 which extend between opposed side walls 60 of the battery compartment 80. Opposed ends 204 and 206 of the elongated member 202 are integrally formed with the opposed side walls 60 of the battery compartment 80. Thus, opposed ends 204 and 206 of the elongated member 202 are flush with respective opposed side walls 60 of the battery compartment 80.

The programmable module portion 200 of the faceplate 10 further includes a rectangular slot 220 that is located next and adjacent to the elongated member 202. The rectangular slot 220 is bounded by end wall 212, elongated member 202 and opposed side walls204 and 206. The rectangular slot 220 further includes tongue portions 210 as illustrated in FIG. 2. The rectangular slot 220 is designed to frictionally hold the module 300. During assembly of the programmable hearing aid (not shown), the module 300 is slid into the rectangular slot 212 of the programmable module portion 200 so that grooves 340 located on the module 300 receive tongues 208 and 210 located in the rectangular slot 220, as best illustrated in FIGS. 4 and 5.

Figure 4:
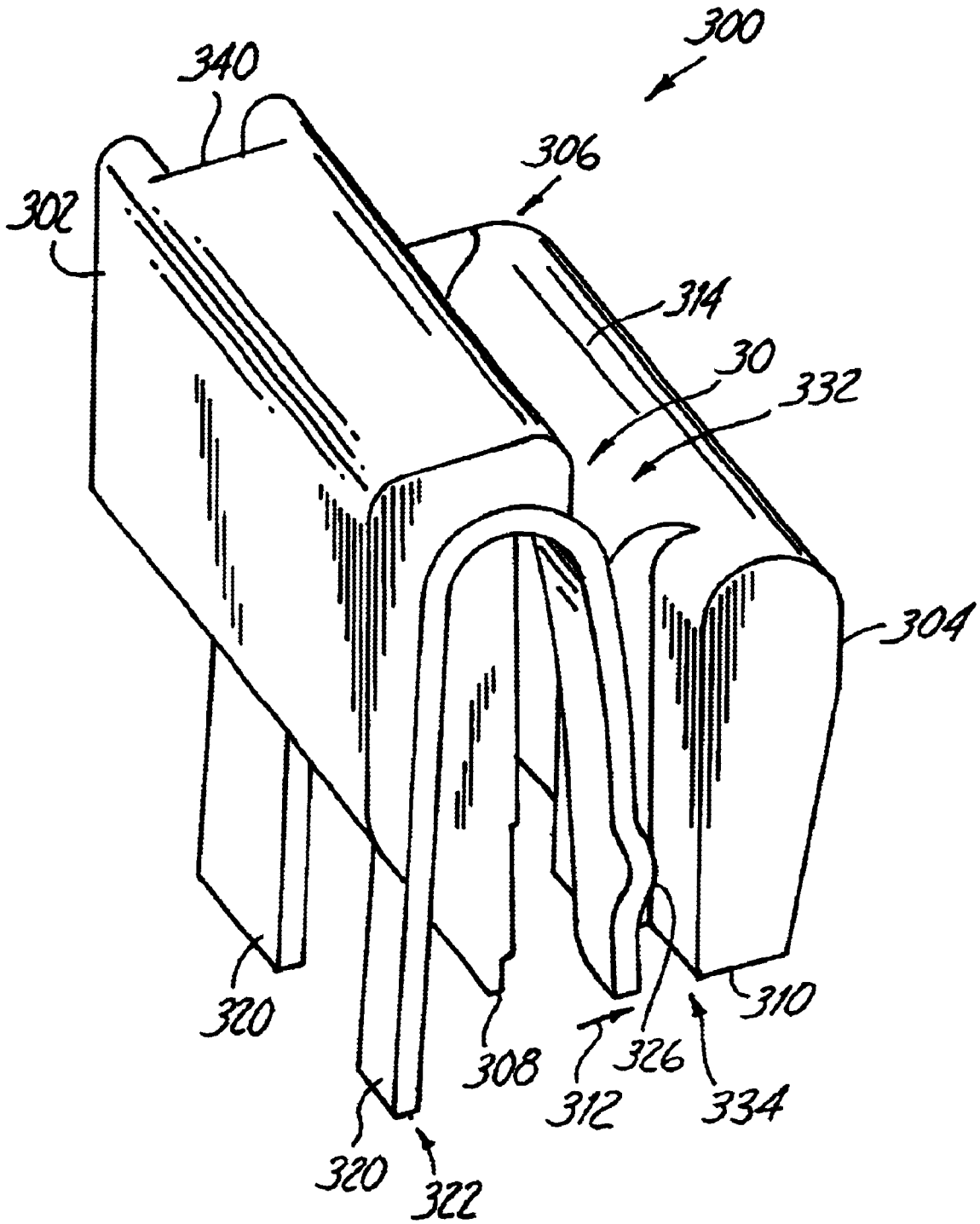
FIG. 4 is a sectional perspective view of a self-contained programmable module for programming a hearing aid.
Figure 5:
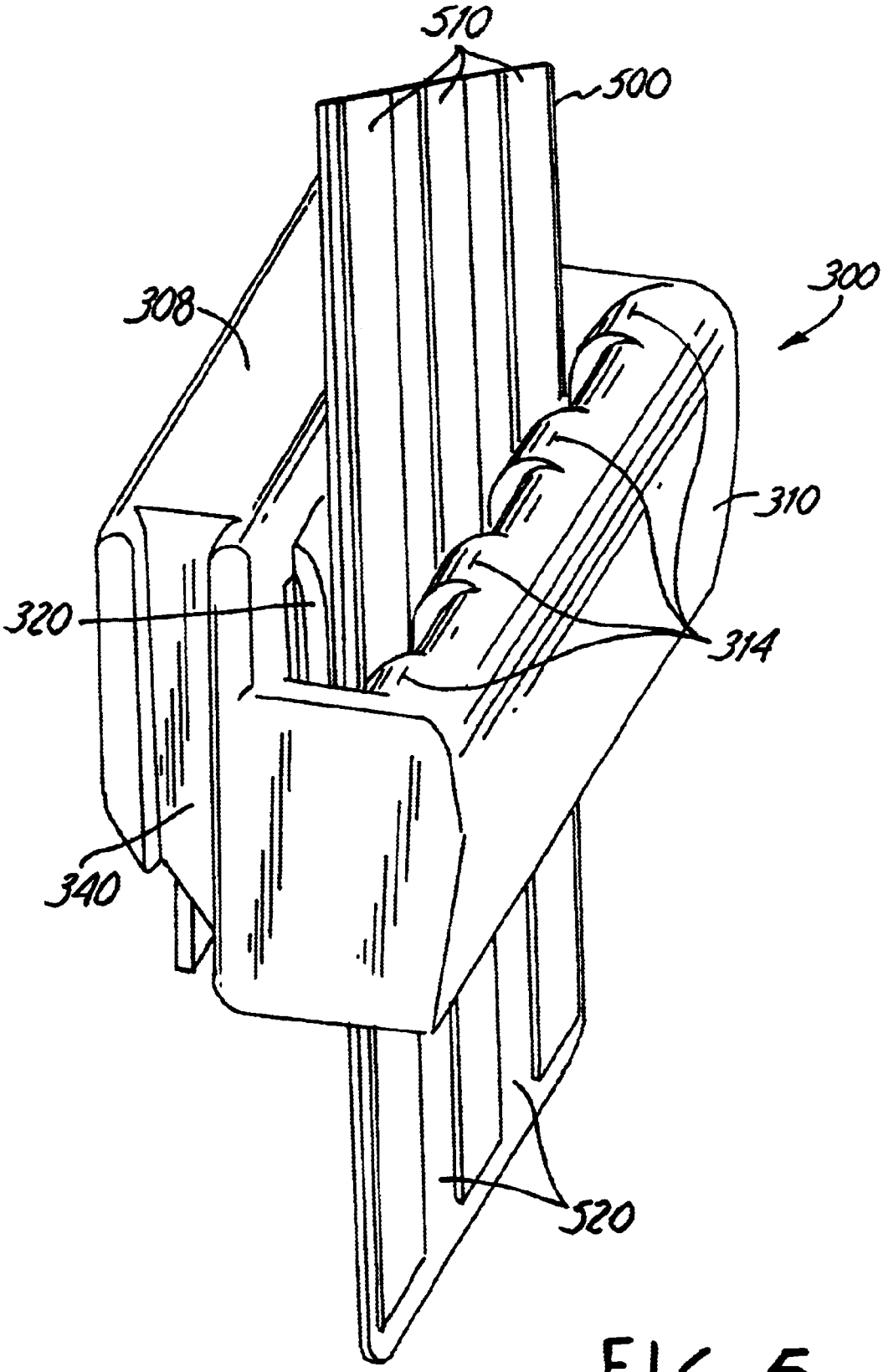
FIG. 5 is a perspective view of a self-contained programmable module that includes a programmable cable for programming a hearing aid.
Figure 6:
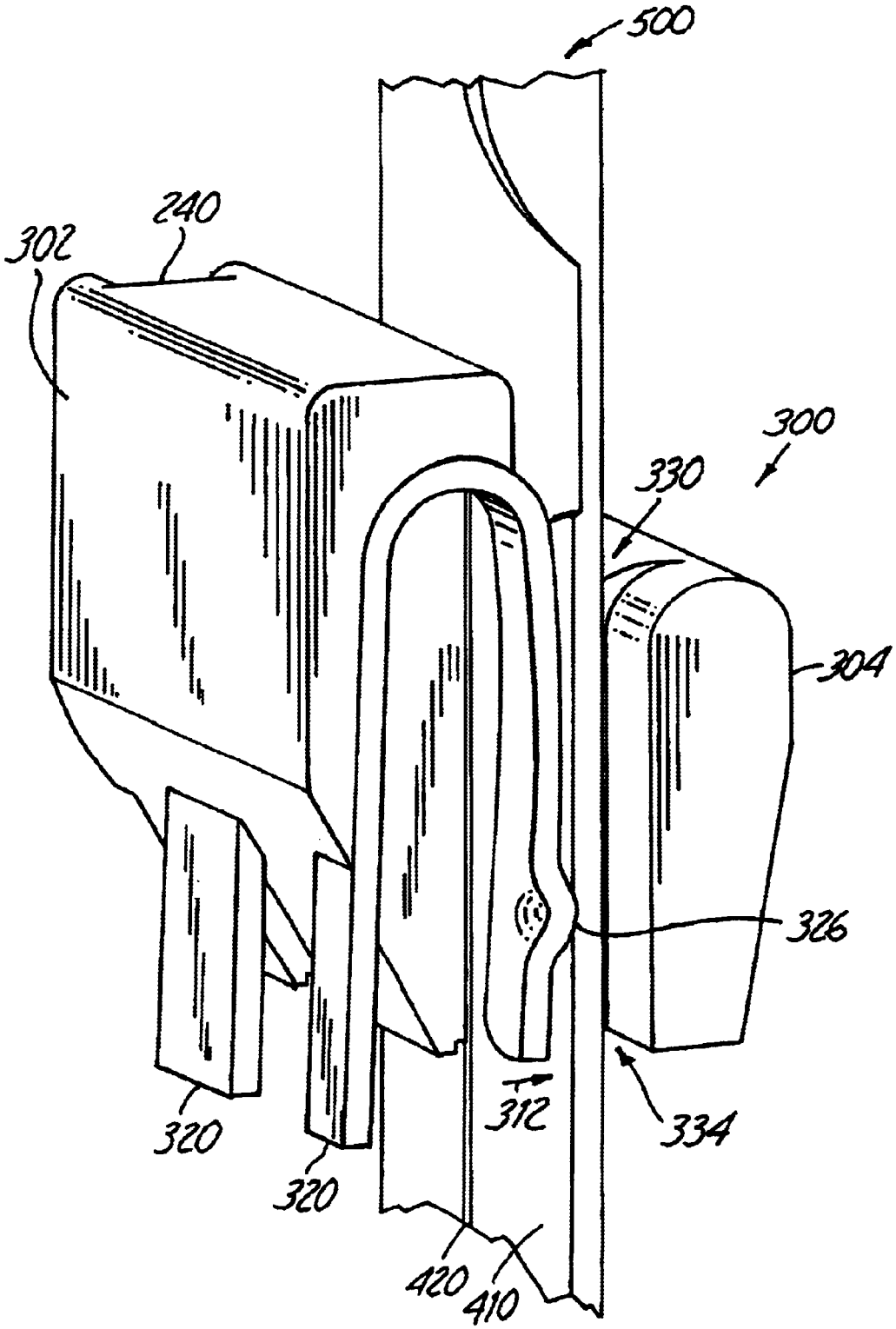
FIG. 6 is a sectional view of a self-contained programmable cable that includes an inserted programmable cable.

The module 300 of the programmable module portion 200 is further illustrated in FIGS. 4, 5, and 6. The module 300 is shaped to frictionally fit into rectangular slot 220 with surface 302 in communication with end wall 212 and surface 304 in communication with retaining flange 140. The module 300 includes a plastic housing 306 that contains a first wall 308 and a second wall 310. The plastic housing 306 is injection molded to form the module 300 and further includes a plurality of electrical leads 320. The electrical leads 320 have a portion within the first wall 308 that anchors the leads 320 and a portion that extends from the wall 308.

The module 300 houses a cable slot 330 that extends through the module 300 for insertion of a programmable cable 500 as illustrated in FIG. 5. The module 300 includes spaced apart shoulders 314 that extend outwardly from wall 310. The shoulders 314 also extend inwardly into cable slot 330 to thereby physically slant an entrance 332 of the cable slot 330. The physically slanted entrance 332 of the cable slot 330 is capable of directing the programmable cable 500 into the cable slot 330. The cable slot 330 furthers tapers toward a circuit exit 334 of the module 300.

The electrical leads 320 of the module 300 extend in a U-shaped curve from wall 308 at end 322 to wall 310 at circuit exit 330, as best depicted in FIG. 6. To further aid in electrical contact between the electrical leads 320 and the programmable cable 500, each electrical lead 320 further preferably includes a hump 326 proximate the circuit end 334.

The programmable cable 500 includes a plurality of electrodes 510 and longitudinal recessed areas 520 between each electrode 510. The shoulders 314 are spaced from each other a distance substantially equal to the width of the electrodes 510. When the programmable cable 500 is inserted into the module 300, the electrodes 510 are positioned between spaced apart shoulders 314. Electronic signals from a programming unit (not shown) can be sent via the electrodes 510 of the programmable cable 500 to program the programmable hearing aid.

When the programmable cable 500 is inserted in the module 300, the physically slanted entrance 332 of the cable slot 330 directionally guides the programmable cable 500 into the cable slot 330. Furthermore, shoulders 314 assist the electrical leads 320 to engage the electrodes 510 of the programmable cable 500 during insertion into the cable slot 330. In addition, the longitudinal recessed areas 520 facilitate proper alignment of the electrodes 510 with the electrical leads 320.

The electrodes 510 of the programmable cable 500 are held in conductive contact with the electrical leads 320 in the cable slot 330 due to a spring-type action of the electrical leads 320. When the programmable cable 500 is directionally inserted into the cable slot 330, the programmable cable 500 rests against wall 310 and pushes back against the electrical leads 320 in a direction indicated by arrow 312 as illustrated in FIG. 6. The spring force against the cable 500 is indicated by arrow 312 in FIGS. 4 and 6. The spring force ensures conductive contact between the leads 510 of the cable 500 and the leads 320.

The hump 326 of each electrical lead 320 further urges the programmable cable 500 to retain contact with each electrical lead 320 for maximum connection and programming of the programmable hearing aid. Since the programmable cable 500 is urged toward the electrical leads 320 by the spring-type action of the electrical leads 320 no additional adjustments or modifications are therefore required to maintain contact between the electrical leads 320 and the leads 510.

The module 300 is a unique design that can accept programmable cables of any shape to make electrical contact with electrical leads since the cable slot can be modified to fit any surface configuration. Furthermore, the physically slanted entrance 332 into the cable slot 330 and the tapered circuit exit 334 of the cable slot 330 directs, aligns and retains the programmable cable 500 within the module 300. In addition, with the programmable module portion 200 capable of being located at any position on the faceplate 10, maximum flexibility during assembly of the programmable hearing aid is afforded to the manufacturer.

The module 300 is preferably formed from a polymeric material having a higher melt temperature then the polymeric material that forms the face place 10. For example, the module 30 is preferably made of nylon 6/6 while the faceplate 10 is made of Tenite® propionate. Preferably, the module 300 is made of a polymeric material such as nylon 6/6 that is better able to withstand soldering temperatures. Wire leads from internal components (not shown) of the hearing aid need to be soldered to ends of the leads 320. When a polymer material having a low melt temperature is used to form the module 300, soldering temperatures may create problems by melting the polymeric material holding the electrical leads 320, since heat will be conducted through the leads into the polymer. The melting of the polymeric material causes the electrical leads 320 to move slightly and therefore, shift the electrical leads 320 out of alignment. Improper alignment or orientation of the electrical leads 320 can reduce the degree of conductive contact with the leads 510 of the cable 500, and therefore, create quality defects which may render the hearing aid problematic or ineffective.

The use of a higher melt temperature polymer for the module 300 rather than the faceplate 10 is also desirable since the faceplate 10 must be cut and molded to form the programmable hearing aid. When a higher melt temperature polymer material is used to form the faceplate 10, cutting and molding the faceplate 10 is substantially more difficult. The use of a lower melt temperature polymeric material to form the faceplate obviates the difficulties in cutting and molding the faceplate during assembly of the programmable hearing aid.

Although the present invention has been described with reference to preferred embodiments, workers skilled in the art will recognize that changes may be made in form and detail without departing from the spirit and scope of the invention.

What is claimed is:

1. A self-contained, discrete programmable hearing aid module for attachment to a hearing aid faceplate and for accepting a plurality of programming leads retained within a cable element, the self-contained, discrete programmable hearing aid module comprising:

a housing including a first and a second wall, wherein the first and second walls define a slot, and wherein the second wall includes a plurality of shoulders extending therefrom into the slot, the shoulders being spaced apart from each other approximately a width of the programming leads to accept the programming leads between the shoulders when the cable element is inserted into the slot; and a plurality of electrical leads extending into the slot and retained by the first wall and positioned with respect to the shoulders such that the electrical leads are disposed in conductive contact with the programming leads of the cable element when the cable element is inserted within the slot, the electrical leads being made of a spring metal and extending into the slot such that the electrical leads act against the programming leads of the cable element when the cable element is within the slot.

2. The self-contained, discrete programmable hearing aid module of claim 1 wherein the housing is made of a polymeric material sufficient to withstand soldering temperatures such that the electrical leads retain alignment during soldering.

3. The self-contained, discrete programmable hearing aid module of claim 2 wherein the polymeric material is nylon 6/6.

4. The programmable hearing aid module of claim 1 wherein the programmable cable has a first thickness, the cable slot has a second thickness, the first thickness being larger than the second thickness.

5. A faceplate and programmable hearing aid module combination, the faceplate and programmable hearing aid combination comprising:

a battery opening disposed within the faceplate, wherein the battery opening is defined by opposed side walls and opposed end walls, and wherein the battery opening is located at a first position on the faceplate;

a module opening disposed within the faceplate, the module opening defined by opposed side edges and opposed end edges, wherein the module opening is located at a second position on the faceplate, and wherein the first position is distinct from the second position on the faceplate;

a self-contained programmable hearing aid module disposed within the module opening, the self-contained programmable hearing aid module comprising:

a housing including a first and a second wall, wherein the first and second walls define a slot, and wherein the second wall includes at least one shoulder extending therefrom into the slot; and a plurality of electrical leads extending into the slot and retained by the first wall and positioned with respect to at least one shoulder such that the electrical leads are disposed in conductive contact with the programming leads of the cable element when the cable element is inserted within the slot.

6. The faceplate and programmable hearing aid module combination of claim 5 wherein the programmable hearing aid module is detachably attached to the faceplate.

7. The faceplate and programmable hearing aid module combination ofelaim 5 wherein the programmable hearing aid module is made of a polymer having a melt temperature sufficient to withstand soldering temperatures such that the electrical leads retain alignment during soldering.

8. The faceplate and programmable hearing aid module combination of claim 7 wherein the polymeric material is nylon 6/6.

9. The faceplate and programmable hearing aid module combination of claim 5 and further including a plurality of shoulders extending from the second wall and spaced apart from each other approximately a width of the programming leads to accept the programming leads between the shoulders when the cable element is inserted into the slot.

10. The faceplate and programmable hearing aid module combination of claim 7 wherein the electrical leads are made of a spring medal and extend into the slot such that the electrical lead act against the programming leads of the cable element when the cable element is within a slot.

11. A programmable hearing aid faceplate, the programmable hearing aid faceplate comprising:

a battery opening disposed within the faceplate, wherein the battery opening is defined by opposed side walls and opposed end walls, and wherein the battery opening is located at a first position on the faceplate;

a module opening positioned within the faceplate, the module opening defined by opposed side edges and opposed end edges, the module opening located at a second position on the faceplate, a programmable module attached to the faceplate in cooperation with the module opening; and wherein the first position is distinct from the second position on the faceplate.

12. The programmable hearing aid faceplate of claim 11 wherein the programmable module further includes a plurality of electrical leads embedded within a wall of the module and wherein the wall is made of a polymeric material sufficient to withstand soldering temperatures such that the electrical leads retain alignment during soldering.

13. The programmable hearing aid faceplate of claim 12 wherein the polymeric material is nylon 6/6.

* * * * *

UNITED STATES PATENT AND TRADEMARK OFFICE

CERTIFICATE OF CORRECTION

PATENT NO. : 6,678,386 B2
DATED : January 13, 2004
INVENTOR(S) : Robinson et al.

It is certified that error appears in the above-identified patent and that said Letters Patent is hereby corrected as shown below:

Column 8,
Line 2, “ofelaim” should be -- of claim --.
Line 18, “medal” should be -- metal --.

Signed and Sealed this

Second Day of May, 2006

JON W. DUDAS
*Director of the United States Patent and Trademark Office*